US010582285B2

(12) United States Patent
Valenzuela

(10) Patent No.: US 10,582,285 B2
(45) Date of Patent: Mar. 3, 2020

(54) COMFORT TIP WITH PRESSURE RELIEF VALVES AND HORN

(71) Applicant: SmartEar, Inc., San Francisco, CA (US)

(72) Inventor: Victor M Valenzuela, Hayward, CA (US)

(73) Assignee: SmartEar, Inc., San Francisco, CA (US)

( * ) Notice: Subject to any disclaimer, the term of this patent is extended or adjusted under 35 U.S.C. 154(b) by 0 days.

(21) Appl. No.: 16/143,596

(22) Filed: Sep. 27, 2018

(65) Prior Publication Data

US 2019/0104354 A1 Apr. 4, 2019

Related U.S. Application Data

(60) Provisional application No. 62/566,402, filed on Sep. 30, 2017.

(51) Int. Cl.
*H04R 1/10* (2006.01)
*H04R 25/00* (2006.01)

(52) U.S. Cl.
CPC ..... *H04R 1/1016* (2013.01); *H04R 1/1041* (2013.01); *H04R 1/1058* (2013.01); (Continued)

(58) Field of Classification Search
CPC ..... H04R 2460/11; H04R 25/456; H04R 25/658; H04R 1/1016; H04R 2225/023; H04R 2225/31; H04R 25/602; H04R 1/1041; H04R 1/1058; H04R 2460/09; H04R 25/556; H04R 25/558; H04R 1/1091; H04R 2225/61; H04R 2460/15; H04R 2460/17; H04R 25/554; H04R 25/60;
(Continued)

(56) References Cited

U.S. PATENT DOCUMENTS 1,852,130 A 4/1932 Schier
1,893,143 A 1/1933 Henry
(Continued)

FOREIGN PATENT DOCUMENTS

WO WO2014/138735 A1 9/2014

OTHER PUBLICATIONS

International Search Report for PCT/US15/57998, and International Written Opinion for PCT/US15/57988, dated Apr. 29, 15 pages.
(Continued)

*Primary Examiner* — Lun-See Lao
(74) *Attorney, Agent, or Firm* — AWA Sweden AB; Thomas L. Ewing

(57) ABSTRACT

An embodiment of the invention provides a comfort tip for a wireless in-ear utility device that provides pressure relief valves that operate mechanically and also offers a horn that increases the wireless in-ear utility device's ability to deliver sound. The horn effect on the comfort tip allows the wireless in-ear utility device to provide higher sound levels while consuming lower battery power. The pressure relief valves provide increased safety and comfort for the user with an automatic valve calibrated to open to relieve excessive back pressure from the tympanic membrane as well as from a dB blast of 25 dB to 35 dB.

12 Claims, 8 Drawing Sheets

(52) U.S. Cl.
CPC ..... *H04R 25/652* (2013.01); *H04R 25/656* (2013.01); *H04R 2460/09* (2013.01); *H04R 2460/11* (2013.01)

(58) Field of Classification Search
CPC ..... H04R 25/652; H04R 25/654; A61B 10/0045; A61B 17/3468; A61B 17/3496; A61B 1/00149; A61B 1/227; A61B 1/32; A61B 2010/0054; A61B 2017/00738; A61B 2090/034; A61B 2090/062; A61B 2090/064; A61B 5/14507; A61B 90/50; A61B 5/12; A61F 11/002; A61F 11/10; A61M 1/0039; A61M 1/0047; H04B 1/04
USPC ..... 381/74, 312, 322, 328, 337, 338, 150; 181/130
See application file for complete search history.

(56) References Cited

U.S. PATENT DOCUMENTS 2,248,837 A 7/1941 Walters
2,619,960 A 12/1952 Reynolds
2,678,973 A 5/1954 Newman
2,754,365 A 7/1956 Walters
2,971,065 A 2/1961 Busse
2,984,726 A 5/1961 Roeser
3,282,106 A 11/1966 Bowling
3,815,583 A 6/1974 Scheidt
3,983,336 A 9/1976 Malek
4,069,400 A 1/1978 Johanson
4,133,984 A 1/1979 Akiyama
4,349,083 A * 9/1982 Bennett ..... H04R 25/48 181/130
4,359,708 A 11/1982 Jarosz
4,539,708 A 9/1985 Norris
4,550,227 A 10/1985 Topholm
5,031,219 A 7/1991 Ward et al.
5,159,936 A 11/1992 Yelderman
5,167,235 A 12/1992 Seacord
5,626,139 A 5/1997 Szeles
5,654,530 A 8/1997 Sauer
5,812,680 A 9/1998 Glendon
6,358,281 B1 3/2002 Berrang
6,648,914 B2 11/2003 Berrang
6,920,229 B2 7/2005 Boesen
7,120,267 B2 10/2006 Ito
8,275,166 B2 9/2012 Wu
8,320,601 B2 * 11/2012 Takigawa ..... H04R 1/1041 381/322
8,389,862 B2 3/2013 Arora
8,634,918 B2 1/2014 Chambers
8,798,298 B1 8/2014 Burns
8,855,345 B2 10/2014 Shennib
8,983,108 B2 3/2015 Ho
9,078,070 B2 7/2015 Samuels
9,456,285 B2 9/2016 Bymaster
9,571,913 B2 2/2017 Masaki
9,986,328 B2 * 5/2018 Suvanto ..... H04R 1/326
2002/0181336 A1 12/2002 Shields
2003/0027606 A1 2/2003 Tsai
2003/0195588 A1 10/2003 Fischell
2004/0224717 A1 11/2004 Hertzberg
2004/0243204 A1 12/2004 Maghribi
2006/0045304 A1 3/2006 Lee
2006/0098833 A1 5/2006 Juneau
2007/0154030 A1 7/2007 Moses
2007/0154049 A1 7/2007 Levitsky
2008/0063231 A1 3/2008 Juneau
2008/0152167 A1 6/2008 Taenzer
2008/0253583 A1 10/2008 Goldstein
2008/0298618 A1 * 12/2008 Baumann ..... H04R 25/656 381/325
2009/0010456 A1 1/2009 Goldstein
2009/0034775 A1 * 2/2009 Burton ..... H04R 1/1016 381/380
2009/0052702 A1 2/2009 Murphy
2009/0143096 A1 6/2009 Chang
2009/0285437 A1 * 11/2009 Takigawa ..... H04R 1/1041 381/380
2010/0002402 A1 1/2010 Rogers
2010/0294285 A1 11/2010 Turdjian
2011/0002498 A1 1/2011 Wong
2011/0300806 A1 8/2011 Lindahl
2011/0224493 A1 9/2011 Oyadiran
2011/0237295 A1 9/2011 Bartkowiak
2011/0264447 A1 10/2011 Visser
2012/0114160 A1 5/2012 Lin
2012/0300965 A1 11/2012 Samuels
2013/0142363 A1 6/2013 Amento
2014/0112520 A1 4/2014 Knudsen
2014/0153761 A1 * 6/2014 Shennib ..... H04R 25/652 381/328
2014/0153762 A1 * 6/2014 Shennib ..... H04R 25/656 381/329
2014/0169599 A1 6/2014 Solum
2014/0172042 A1 6/2014 Goorevich
2014/0301561 A1 10/2014 Silberman
2014/0303452 A1 10/2014 Ghaffari
2015/0110313 A1 4/2015 Feilner
2015/0183167 A1 7/2015 Molinari
2015/0230022 A1 8/2015 Sakai
2015/0261298 A1 9/2015 Li
2015/0281861 A1 10/2015 Karamuk
2016/0049074 A1 2/2016 Shennib
2016/0057550 A1 2/2016 Shennib
2016/0162256 A1 6/2016 Komaromi
2016/0192050 A1 6/2016 Masaki
2016/0206000 A1 7/2016 Lord
2016/0247380 A1 8/2016 Kumar
2017/0262698 A1 9/2017 Hoffman

OTHER PUBLICATIONS

"Wireless Headphones | Koss Striva Tap Wi-Fi Earbuds" by Mila Pantovich Jun. 8, 2012, JustLuxe, pp. 1-3, http://www.justluxe.com/lifestyle/electronics/feature-1780526.php (retrieved Apr. 16, 2017).
"Here Active Listening earbuds: Augmented reality for your ears (hands-on)" by Will Shanklin, Jan. 13, 2016, pp. 1-4, http://newatlas.com/doppler-labs-here-earbuds-hands-on/41322/ (retrieved Apr. 16, 2017).
Nap Zapper Anti-Sleep Alarm, Amazon, pp. 1-6, https://www.amazon.com/Generic-Nap-Zapper-Anti-Sleep-Alarm/dp/B000BK4KW8 (retrieved Apr. 16, 2017).
International Search Report for PCT/US18/53249, and International Written Opinion for PCT/US18/53249, dated Nov. 20, 2018, 20 pages.

* cited by examiner

COMFORT TIP WITH PRESSURE RELIEF VALVES AND HORN

FIELD

Embodiments of the invention relate to systems and methods pertaining to in-ear utility devices. More particularly, an embodiment of the invention relates to systems and methods that provide comfort tips on in-ear utility devices configured to provide pressure relief and assist in sound reproduction.

BACKGROUND

The following description includes information that may be useful in understanding embodiments of the invention. It is not an admission that any of the information provided herein is prior art or relevant to the presently claimed invention, or that any publication specifically or implicitly referenced is prior art.

With the development of portable multimedia devices and smart phones, many types of ear pieces, such as earphones and headsets, have been developed and used. However, previous ear pieces have traditionally been bulky and uncomfortable as well as being limited in their technological abilities. Thus, the prospects for exploring new form factors for ear pieces have conventionally been limited.

Therefore, a need exists for more advanced in-ear utility devices that facilitate the comfortable wearing of in-ear utility devices for long periods of time and under a variety of conditions, especially in comparison with the devices found in the prior art.

SUMMARY OF THE INVENTION

Embodiments of the invention provide a comfort tip for protecting a user's ear canal from the solid device portion of a wireless in-ear utility device and provides mechanical regulation of excessive air pressure in the user's inner ear region. The comfort tip includes a body portion configured to removably fit onto the solid device portion of a wireless in-ear utility device. A first pressure relief opening on a surface of the body portion resides closest to the user's tympanic membrane when the wireless in-ear utility device is inserted in the user's ear. The first pressure relief opening is configured to allow passage of air between the user's inner ear region and the ambient environment, wherein the inner ear region comprises a portion of the user's ear canal between the proximal end of the wireless in-ear utility device and the user's tympanic membrane. A second pressure relief opening on a surface of the body portion also resides closest to the user's tympanic membrane when the wireless in-ear utility device is inserted in the user's ear. The second pressure relief opening is configured to allow passage of air between the ambient environment and the user's inner ear region. A first pressure relief flap covers the first pressure relief opening when in closed position. The first pressure relief flap is configured to mechanically open to decrease pressure in the user's inner ear when a harmful positive air pressure occurs in the user's inner ear region. A second pressure relief flap covers the second pressure relief opening when in closed position. The second pressure relief flap is configured to mechanically open to increase pressure in the user's inner ear when a harmful negative pressure occurs in the user's inner ear region. Embodiments of the comfort tip may also include a horn on the comfort tip that provides natural amplification of sounds generated by a speaker on the solid device portion of the wireless in-ear utility device.

BRIEF DESCRIPTION OF THE DRAWINGS

Figures provided herein may or may not be provided to scale. The relative dimensions or proportions may vary. Embodiments of the invention may be sized to fit within an ear canal of a user.

DETAILED DESCRIPTION OF AN EMBODIMENT OF THE INVENTION

Figure 1:
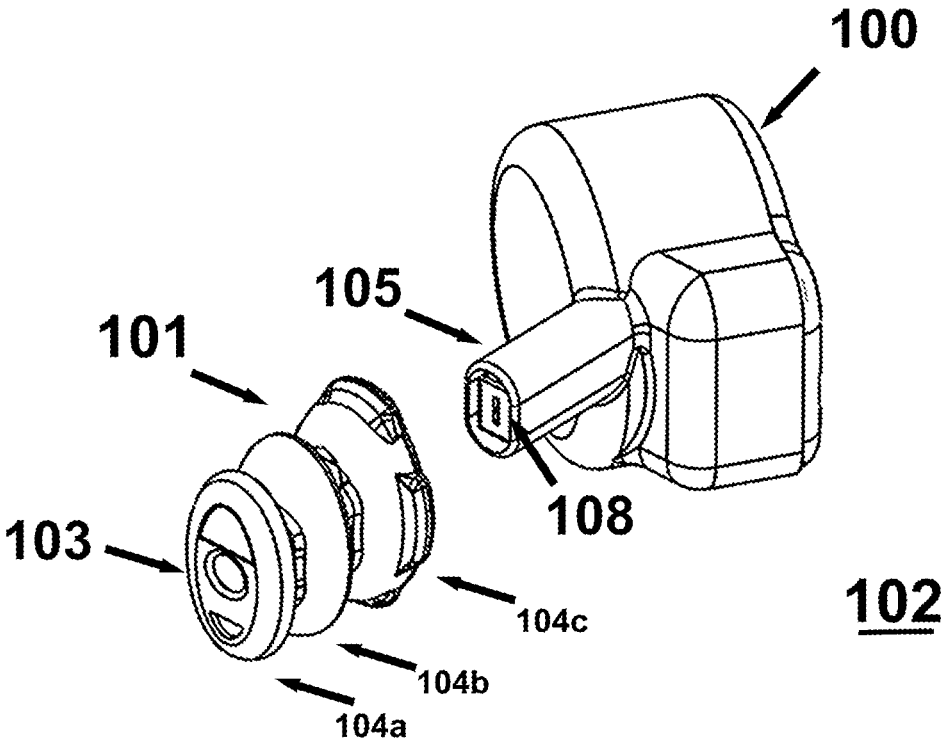
FIG. 01 illustrates a wireless in-ear utility device 102 have a solid device portion 100 and a comfort tip 101, according to an embodiment of the invention.

Embodiments of the invention provide an improved comfort tip (also known as a "seal for use with a wireless in-ear utility device. The improved comfort tip includes a pressure release system comprising pressure relief openings and pressure relief flaps. These pressure relief valves on the comfort tip provide increased safety and comfort for the user with the automatic valve calibrated to open to relieve excessive back pressure from the tympanic membrane as well as from a dB blast of 25 dB to 35 dB, according to an embodiment of the invention.

Embodiments of the pressure release system operate mechanically and do not require electronic components to relieve pressure in contrast to many ear-borne pressure relief mechanisms found in the prior art. Thus, no electronic hardware or programming is required in the wireless in-ear utility device to operate the instant pressure relief system or monitor that the pressure relief system is operating correctly, according to an embodiment of the invention.

The combination of pressure relief valve openings and pressure relief flaps allows the comfort tip to respond to changes in pressure that could cause harm to a user's ear when a wireless in-ear utility device is worn in the user's ear, according to an embodiment of the invention. The flaps operate to relieve pressure build up inside the ear canal between the tympanic membrane and the in-ear utility device as well as relieving negative pressure caused when the in-ear utility device is removed from the ear, according to an embodiment of the invention. Wireless in-ear utility devices are often inserted farther into a user's ear canal than other ear-borne device and thus their removal often creates a greater suction effect.

The improved comfort tip may also include a speaker port opening that has been designed to utilize the horn effect, according to an embodiment of the invention. Providing the horn effect in the speaker port of the comfort tip may cause a significant increase in the level of sound (by approximately 5 dB to 10 dB) produced by the speaker of the in-ear utility device. Increasing the level of sound using the horn effect on the speaker port of the comfort tip allows the wireless in-ear utility device to lower the amount of power required for sound production and thus reduce demands on battery power for the wireless in-ear utility device, according to an embodiment of the invention.

Embodiments of the wireless in-ear utility device may be used for a variety of purposes and may include a variety of electronic packages, such as for use as an amplified hearing device, for use as a music player, for use as a headphone device, and for use in various health-monitoring applications. Embodiments of the invention provide a wireless in-ear utility device configured to have a variety of electronic packages. The electronic packages may serve a variety of functions, such as a Bluetooth device, a noise cancellation device that allows the user to focus on sounds of interest, a health-monitoring device, and a fitness device, each embodiment having the sensors and electronic configuration needed to carry out its mission.

FIG. 01 illustrates a wireless in-ear utility device 102 having a solid device portion 100 and a comfort tip 101, according to an embodiment of the invention. The comfort tip 101 is shown separated from the solid device portion 100, but in operation, the comfort tip 101 fits over a stem 105 extending from the solid device portion 100 to form a unified wireless in-ear utility device 102, according to an embodiment of the invention. Comfort tips are also known as "seals."

The comfort tip 101 aims to optimize the quality of the acoustic sound performance and to protect the user's ear drum from any excessive back pressure build up as well as from a dB blast of 25 dB to 35 dB, according to an embodiment of the invention.

As will be disclosed, the body of the comfort tip 101 includes special pressure relief valves on a portion of the comfort tip 101 that resides close to the user's tympanic membrane when the wireless in-ear utility device 102 is in operation. The comfort tip 101 comprises a body that includes the solid features of the comfort tip. Among other things, the body of the comfort tip 101 contains three support ridges 104*a*, 104*b*, and 104*c* designed to provide better retention in the user's ear, according to an embodiment of the invention. The support ridges 104*a*, 104*b*, and 104*c* decrease in diameter the closer they will reside to the user's tympanic membrane when the wireless in-ear utility device is in the user's ear. Increasingly diminishing the size of the support ridges 104*a*, 104*b*, and 104*c* also aids in the insertion of the in-ear utility device 102 into the user's ear.

When the wireless in-ear utility device 102 is inserted into the user's ear during operation, the body of the comfort tip 101 rests inside the user's ear canal, and sounds may be played from the speaker 108 to the user via a speaker port 103, which represents the part of the wireless in-ear utility device 102 that rests the closest to the user's tympanic membrane.

The wireless in-ear utility device 102 typically touches the user's ear canal at the points where the body of the comfort tip 101 touches the ear canal. The comfort tip 101 does not typically cover portions of the in-ear utility device 102 that reside outside the user's ear canal, according to an embodiment of the invention. The solid device portion 100 does not typically touch the user's ear canal because of the intervening comfort tip 101.

The body of the comfort tip 101 may be configured to create gaps between the wireless in-ear utility device 102 and the ear canal, according to an embodiment of the invention. These gaps not only lower pressure in the ear canal, the gaps also serve the additional purpose of allowing ambient sounds to pass through to the user's eardrum. Thus, a user wearing the in-ear utility device 102 may continue to experience ambient sounds in a natural manner (e.g., constant sound stimulus), and the user's own voice should sound normal to him/her. The ability to still hear ambient sounds naturally while wearing an ear-borne hearing device does not commonly occur with devices such as headphones and hearing aids. In addition, having the solid device portion 100 not touch the ear canal should also increase user comfort and provide better heat transfer, allowing the in-ear utility device 102 to be worn for extended periods of time, according to an embodiment of the invention.

The comfort tip 101 allows the section of the solid device portion 100 that rests in the user's ear canal (e.g., the stem 105) to be narrower than the ear canal. Thus, the solid device portion 100 contains electrical components that do not typically touch the user's ear canal. The presence of the comfort tip 101 protects the user against malfunctions of the electronics in the solid device portion 100. So, for example, if a battery in the solid device portion 100 happens to develop a short, the user should be protected from shock and heat because of the presence of the comfort tip 101. The user is protected by the comfort tip 101 in part because many embodiments of the comfort tip 101 are constructed from a non-metallic material (i.e., lower heat transfer and possibly insulating).

The distance of the in-ear utility device 102 to a given user's eardrum varies based on the depth of the user's ear canal. Some users have shallow ear canals while other users have deep ear canals. Therefore, the distance of the in-ear utility device 102 to the user's tympanic membrane may vary from user to user.

The distal end (e.g., the outer end of the solid device portion 100 of the in-ear utility device 102) resides just outside the user's ear so that the in-ear utility device 102 may be easily removed by hand, according to an embodiment of the invention. In some embodiments of the invention, the in-ear utility device 102 might reside inside the ear canal with no part of the device outside the ear, but such an embodiment would still be covered with the comfort tip 101.

The wireless in-ear utility device 102 includes the speaker 108, according to an embodiment of the invention. In some embodiments, the speaker 108 may contact the eardrum with the possible assistance of an audiologist. (The assistance of an audiologist is not normally needed for proper operation of the in-ear utility device 102.) In some embodiments of the invention, the in-ear utility device may reside in a broader range than 8 to 12 mm. from the user's eardrum 104, e.g., 3 mm. to 15 mm. The 8 to 12 mm. range, however, should provide improved sound quality to the user while also residing at a distance that does not typically require the employment of an audiologist to satisfy health and safety regulations.

The speaker 108 may be a significantly smaller speaker than typically found in Bluetooth devices. This smaller speaker 108 in combination with the smaller form factor of the solid device portion 100 allows the in-ear utility device 102 to penetrate farther into the user's ear canal than a conventional Bluetooth device.

An electronic component package is fixed inside, mounted on, and/or embedded in or on the solid device portion 100 of the in-ear utility device 102, according to an embodiment of the invention. This electronic component package includes components such as the speaker 108, according to an embodiment of the invention. The comfort tip 101 reduces the size available for the electronic component package. Thus, the specific components in the electronic component package may need to be carefully selected for small size, in addition to other characteristics, according to an embodiment of the invention.

The body of the comfort tip 101 deforms when the in-ear utility device 102 is inserted into a user's ear canal without damaging the in-ear utility device 102 or causing harm to the user's ear. The deformable comfort tip 101 cushions the user's ear canal from the hard material covering the solid device portion 100.

The body of the comfort tip 101 should be comfortable for the user in order for the user to be able to wear the in-ear utility device 102 for long periods of time. Comfort from the comfort tip 101 comes from making the comfort tip 101 in a size that fits well into the user's ear canal. Comfort for the comfort tip 101 also comes from making the comfort tips from a flexible and soft material.

Studies show that the cross-sectional area in the middle portions of the typical human ear canal range between 25 $mm^2$ and 70 $mm^2$. Thus, the embodiments of the comfort tip 101 need to cover a fairly wide range of diameters. Thus, the comfort tip 101 may be available in a variety of sizes, although the solid device portion 100 may be manufactured in a single size, according to an embodiment of the invention. For example, the comfort tip 101 covering the solid device portion 100 may be customized to account for variations in size of user's ear canals (e.g., small, medium, and large).

The comfort tip 101 can be fabricated from many resilient polymeric materials known in the art, according to an embodiment of the invention. There are many known resilient polymeric materials that may be used to form the comfort tip 101. For example, natural rubber, neoprene rubber, SBR rubber (styrene block copolymer compounds), silicone rubber, EPDM rubber, polybutadiene rubber, polyvinylchloride elastomers, polyurethane elastomers, ethylene vinyls, acetate elastomers, elastomers based on acrylic acid precursors and vinyhalide polymers may all be generally suitable materials which can be used to provide the necessary softness for the comfort tip 101. The comfort tip 101 covering the in-ear utility device 102 is formed of a material that has a Shore A Durometer hardness value (by a technique such as ASTM 2240-81) of between 20-30, according to an embodiment of the invention.

Any number of tasks may be performed by the in-ear utility device 102, according to an embodiment of the invention. The wireless in-ear utility device 102 and the solid device portion 100 may comprise a variety of in-ear devices, such as hearing aids. The device electronics reside in the solid device portion 100 and not in the comfort tip 101, according to an embodiment of the invention.

The wireless in-ear utility device 102 may preferably be a wireless in-ear utility device of the type described in the following U.S. patent applications; U.S. patent application Ser. No. 15/163,843, entitled "In-Ear Utility Device Having Tap Detector," ; U.S. patent application Ser. No. 15/163,873 entitled "In-Ear Utility Device Having Dual Microphones," ; U.S. patent application Ser. No. 15/163,891 entitled "In-Ear Utility Device Having Sensors," ; U.S. patent application Ser. No. 15/163,908 entitled "In-Ear Utility Device Having A Humidity Sensor," ; U.S. patent application Ser. No. 15/163,931 entitled "In-Ear Utility Device Having Information Sharing," and U.S. patent application Ser. No. 15/163,949 entitled "In-Ear Utility Device Having Voice Recognition" , which are assigned to the assignee of the present application. These applications are incorporated herein by reference in their entirety.

Figure 2:
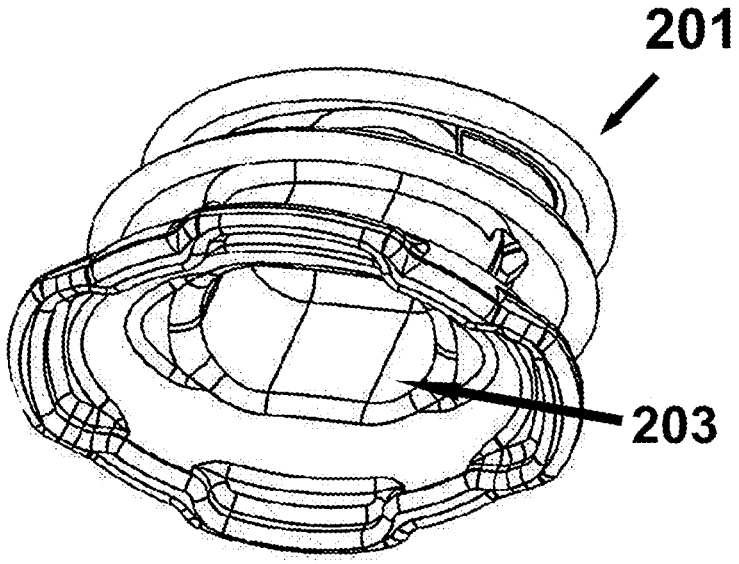
FIG. 02 illustrates an embodiment of the invention in which a comfort tip cavity 203 of the comfort tip 201 has been designed to accommodate an oval stem from the solid device portion of a wireless in-ear utility device, such as the stem 105 shown on the solid device portion 100 shown in FIG. 01, according to an embodiment of the invention.

FIG. 02 illustrates an embodiment of the invention in which a comfort tip cavity 203 of the comfort tip 201 has been designed to accommodate an oval stem from the solid device portion of a wireless in-ear utility device, such as the stem 105 shown on the solid device portion 100 shown in FIG. 01, according to an embodiment of the invention. The comfort tip cavity 203 has an oval shape that has been designed to accommodate the oval stem 105 on the solid device portion 100, according to an embodiment of the invention. The solid device portion 100 includes the stem 105 that is surrounded by the comfort tip cavity 203 when the comfort tip 201 is attached to the solid device portion 100.

The comfort tip cavity 203 facilitates placing a wireless in-ear utility device into small ear canals. A plastic clip insert bonded to the comfort tip 201 allows the comfort tip 201 to snap on and off the device housing, e.g., the solid device 100 shown in FIG. 01. An embodiment of the plastic clip insert is shown in FIG. 03.

The comfort tip cavity 203 could be designed to have other shapes, such as a rectangular shape. However, for many comfort tip cavity designs other shapes (e.g., a rectangular opening) are likely to be more difficult to insert comfortably into a sizeable portion of the ear canals of the potential users of the in-ear utility device.

Figure 3:
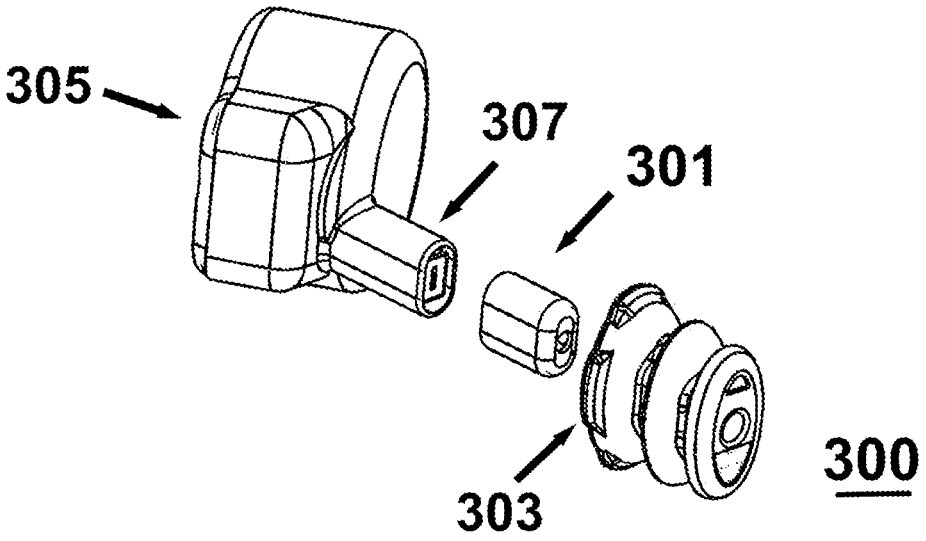
FIG. 03 illustrates a wireless in-ear utility device 300 in which a plastic clip insert 301 for the comfort tip 303 allows the comfort tip 303 to snap on and off the solid device portion 305, according to an embodiment of the invention.
Figure 4:
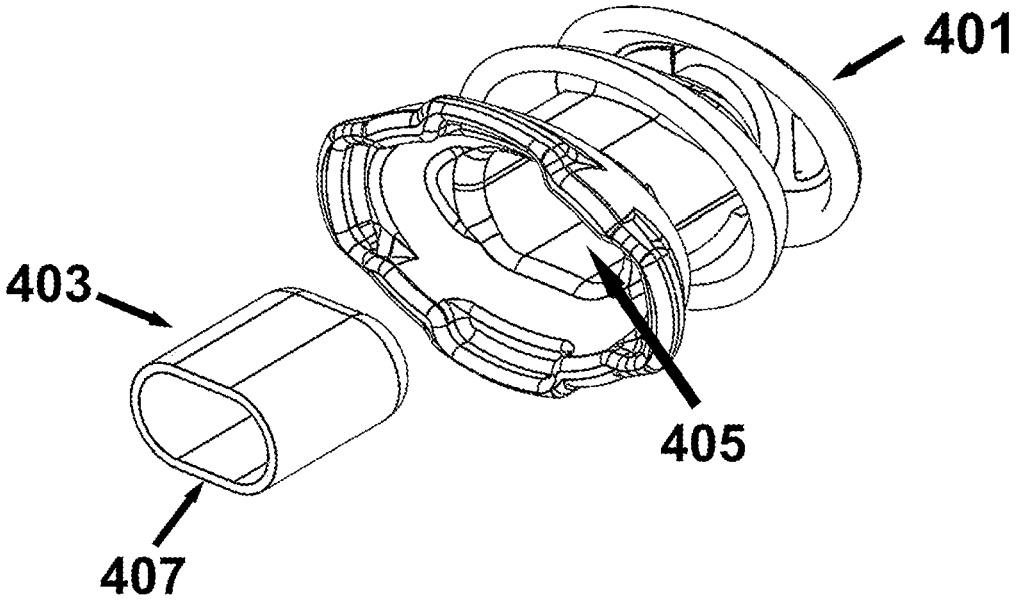
FIG. 04 illustrates a plastic clip insert 403 being inserted into an oval cavity 405 on a comfort tip 401, according to an embodiment of the invention.

FIG. 03 illustrates a wireless in-ear utility device 300 in which a plastic clip insert 301 for the comfort tip 303 allows the comfort tip 303 to snap on and off the solid device portion 305, according to an embodiment of the invention. As shown in FIG. 04, the plastic clip 301 fits into a cavity (e.g., the cavity 405) in the comfort tip 303. The plastic clip insert 301 can be bonded to the comfort tip 303 using a conventional epoxy, according to an embodiment of the invention.

The dimensions of the plastic clip insert 301 are such that its outer dimension fits securely within a cavity on the comfort tip 303 and its inner dimension fits or snaps securely to a stem section 307 of the solid device portion 305, according to an embodiment of the invention.

FIG. 04 illustrates a plastic clip insert 403 being inserted into an oval cavity 405 on a comfort tip 401, according to an embodiment of the invention. The plastic clip insert 403 is preferably inserted into the oval cavity 405 up to the distal end 407 of the plastic clip insert 403. In other words, the plastic clip insert 403 is essentially buried within the comfort tip 401, according to an embodiment of the invention.

Figure 5:
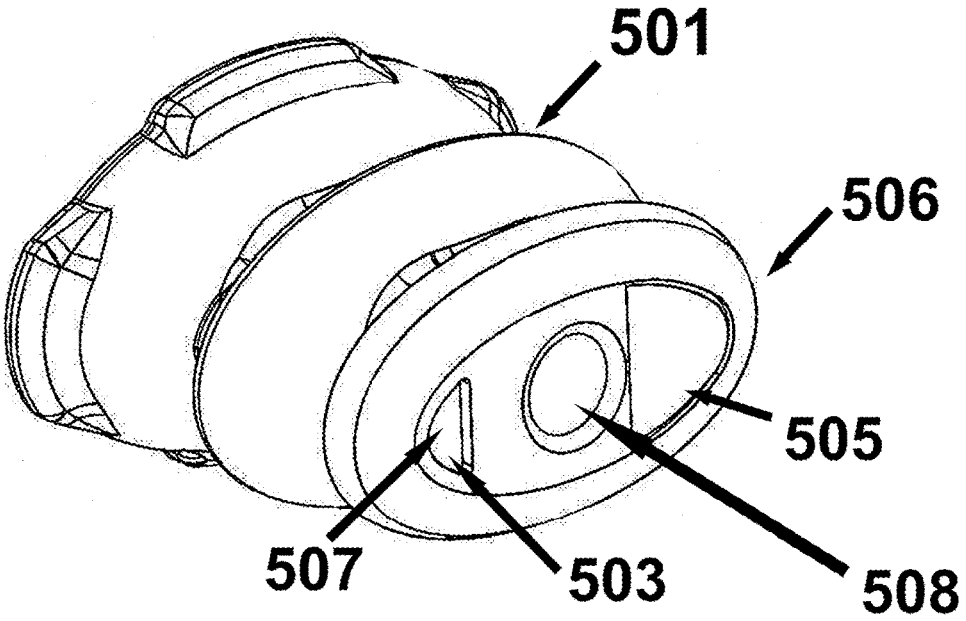
FIG. 05 illustrates an embodiment of a comfort tip 501 having two pressure relief flaps 503, 505, according to an embodiment of the invention.

FIG. 05 illustrates an embodiment of a comfort tip 501 having two pressure relief flaps 503, 505, according to an embodiment of the invention. The flaps 503, 505 are attached to a portion 506 of the comfort tip 501 that resides closest to the user's ear and user's tympanic membrane during in-ear operation.

The pressure relief flaps 503, 505 are shown in the closed position in FIG. 05. When the pressure relief flaps 503, 505 are closed, the comfort tip 501 attains its optimum the acoustic sound performance. In other words, the user receives the best acoustic performance from sounds emitted by a speaker on the wireless in-ear utility device (e.g., the speaker 108 on the wireless in-ear utility device 102 shown in FIG. 1). Sounds from the wireless in-ear utility device are emitted via the speaker port 508 on the comfort tip 501, according to an embodiment of the invention. The speaker port 508 allows sounds from a speaker on the solid device (e.g., the solid device portion 100 shown in FIG. 01) to be transmitted to the user's ear.

The pressure relief flaps 503, 505 are designed to open when there is a dangerous change in pressure between the backend of the comfort tip 501 and the user's ear drum cavity. Having the flaps 503, 505 open protects the user's ear drum from sudden loud noises and from the suction effect caused when the in-ear utility device is removed from the user's ear canal. The flaps 503, 505 close again automatically once the pressure has returned to safe levels.

One pressure relief flap 503 opens inward towards the wireless in-ear utility device while the other pressure relief flap 505 opens outward towards the user's tympanic membrane. Thus, the pressure relief flaps 503, 505 can collectively relieve excessive pressure on both sides of the comfort tip 501. For this reason, one pressure relief flap 503 is mounted on an inside surface of the comfort tip 501 and opens inward while the other pressure relief flap 505 is mounted on an exterior surface of the comfort tip 501 and opens outward, according to an embodiment of the invention.

The pressure relief flaps 503, 505 are approximately the same size, and the holes that they cover in the comfort tip 501 are also approximately the same size. A pressure escape hole 507 is shown in FIG. 05 because the pressure relief flap 503 is mounted on the inside of the comfort tip 501. In contrast, the pressure escape hole corresponding to pressure relief flap 505 cannot be seen in FIG. 05 because the pressure relief flap 505 is mounted on an external surface of the comfort tip 501.

The pressure relief flaps 503, 505 could be differently configured. In other words, the pressure relief flap opening towards the outside could be placed on the left-hand side of the comfort tip rather than the right-hand side. In fact, the comfort tip is symmetrical about its horizontal axis, so the user could even have the pressure relief flap 505 located on the left-hand side by simply rotating the comfort tip 501 before attaching the comfort tip 501 to the solid device. Similarly, the pressure relief flap 507 could be sized differently in relation to the pressure relief flap 505, according to an embodiment of the invention.

Figure 6:
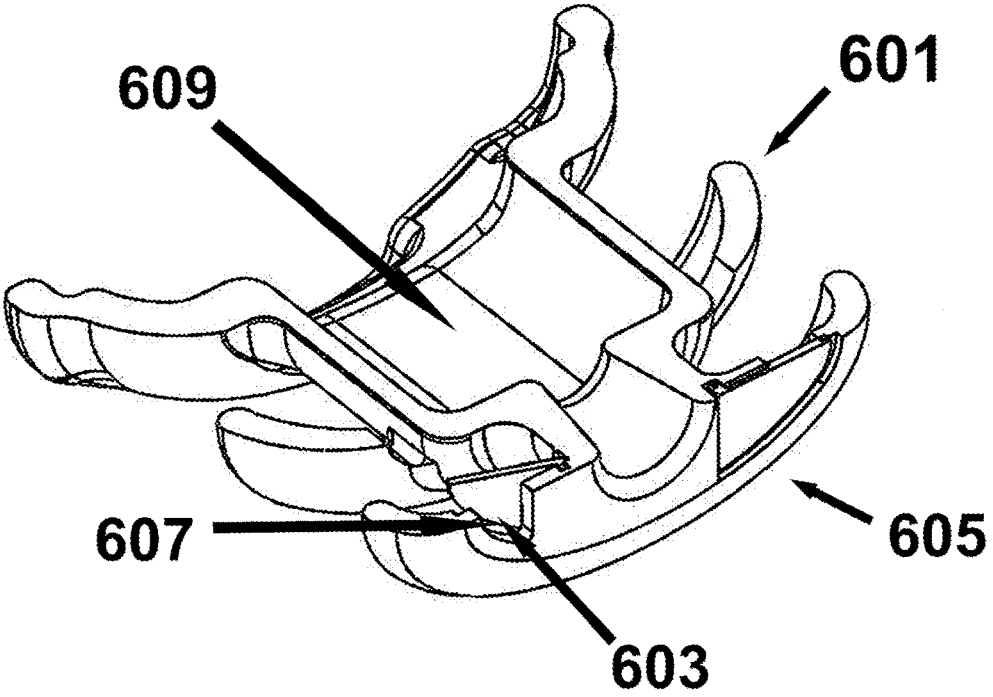
FIG. 06 illustrates pressure relief flaps 603, 605 of a comfort tip 601 shown in a cut away view, according to an embodiment of the invention.

FIG. 06 illustrates pressure relief flaps 603, 605 of a comfort tip 601 shown in a cut away view, according to an embodiment of the invention. When the flaps 603, 605 are closed, the comfort tip 601 attains its optimum the acoustic sound performance, as previously discussed.

The pressure relief flap 603 is designed to open when there is a buildup of excessive back pressure between the backend of the comfort tip 601 and the user's ear drum cavity as well as opening from a dB blast of 25 dB to 35 dB, Opening the pressure relief flap 603 allows excess air to pass through pressure relief hole 607. The pressure relief flap 605 operates similarly to the pressure relief flap 603 but opens in the opposite direction and allows air to pass through a corresponding pressure relief hole not shown in FIG. 06 because the flap 605 is in a closed position. Having the flaps 603, 605 open protects the user's ear drum from sudden loud noises and sudden changes in pressure. The flaps 603, 605 are designed to control negative/positive pressure changes that might be harmful to the user's ear.

The flap 605 works with a negative pressure of approximately 0.125 psi to 0.25 psi as the wireless in-ear utility device being removed from the ear canal, according to an embodiment of the invention. The flap 603 opens with a positive pressure of 0.125 psi to 0.25 psi created by the sound pressure delivered by the speaker, according to an embodiment of the invention.

The flaps 603, 605 close again automatically once the pressure has returned to safe levels. The thickness of the flaps 603, 605 allows them to have spring-like qualities that make the flaps 603, 605 return to a closed position once the pressure has been relieved. Embodiments of the flaps 603, 605 are further disclosed herein, including but not limited to FIG. 14.

Figure 7:
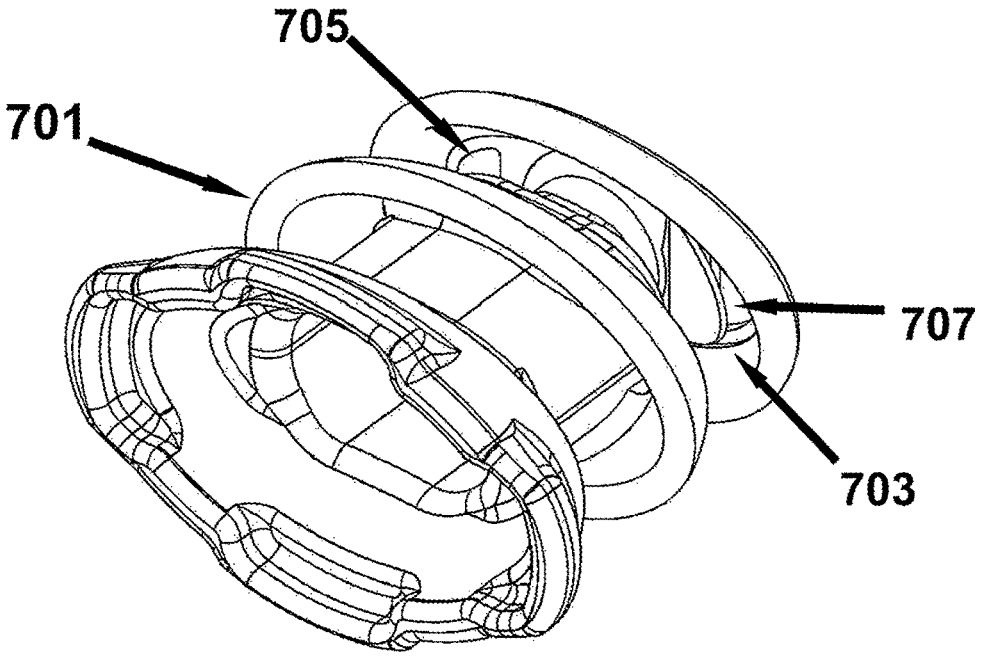
FIG. 07 illustrates pressure relief flaps 703, 705 shown from the backend of comfort tip 701, according to an embodiment of the invention.

FIG. 07 illustrates pressure relief flaps 703, 705 shown from the backend of comfort tip 701, according to an embodiment of the invention. As shown in FIG. 07 a pressure relief flap 703 on a comfort tip 701 is shown in an open position, according to an embodiment of the invention. In the open position, excessive pressure that may have built up by sound or a change in altitude will be relieved through a vent 707 into the atmosphere. The vent corresponding to the pressure relief flap 705 is not shown because the pressure relief valve 705 is closed in FIG. 07.

The pressure relief flaps 703, 705 are designed to open at an inner ear pressure that is deigned to be excessive or approaching excess, according to an embodiment of the invention. Various health and safety requirements may state differing levels of safe pressure. For example, in an embodiment of the invention, the pressure relief flaps 703, 705 open at approximately 0.125 to 0.25 PSI. The pressure at which the pressure relief flaps 703, 705 open can be controlled by varying the shape and thickness of the pressure relief flaps 703, 705 and by varying the surface area of the vent 707, according to an embodiment of the invention.

Once pressure has been relieved, then the pressure relief flaps 703, 705 swing back shut automatically in order to return to optimal acoustic performance, according to an embodiment of the invention. As discussed herein, the pressure relief flaps 703, 705 have a spring-like tension at their attachment to the comfort tip 701 that acts to draw the pressure relief flaps 703, 705 into a closed position, according to an embodiment of the invention.

Figure 8:
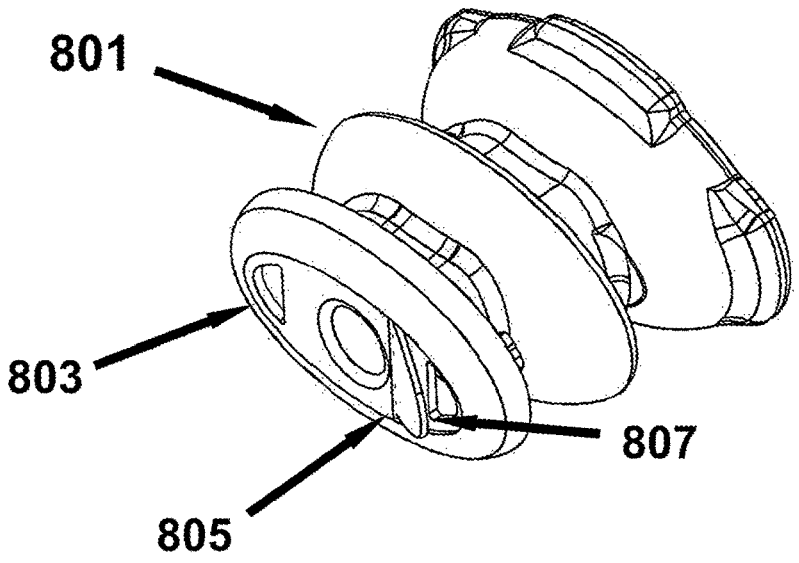
FIG. 08 illustrates pressure relief flap 805 on comfort tip 801 automatically opening as the wireless in-ear utility device (e.g., the wireless in-ear utility device 100 shown in FIG. 01) is being removed from the user's ear canal, according to an embodiment of the invention.

FIG. 08 illustrates pressure relief flap 805 on comfort tip 801 automatically opening as the wireless in-ear utility device (e.g., the wireless in-ear utility device 102 shown in FIG. 01) is being removed from the user's ear canal, according to an embodiment of the invention. The pressure relief flap 803 stays closed since it has been mounted on the inside of the comfort tip 801, and the pressure relief flap 803 experiences no pressures that would cause it to open.

Automatically opening the pressure relief flap 805 when the wireless in-ear utility device (e.g., the wireless in-ear utility device 102 shown in FIG. 01) is removed from the user's ear canal reduces the suction effect and discomfort or trauma to the user's ear drum.

The pressure relief flap 805 effectively detects the suction effect as the relative pressures on both sides of the pressure relief inlet 807 begin to change as the wireless utility device is being removed from the user's ear canal. Various health and safety codes may have different requirements for such situations. According to one embodiment of the invention, the pressure relief valve flaps 803, 805 open when the pressure differential on the pressure relief flaps 803, 805 differs by approximately 0.125 PSI. The pressure at which the pressure relief flaps 803, 805 open can be controlled by varying the shape and thickness of the pressure relief flaps 803, 805 and by varying the surface area of the vent 807, according to an embodiment of the invention.

Figure 9:
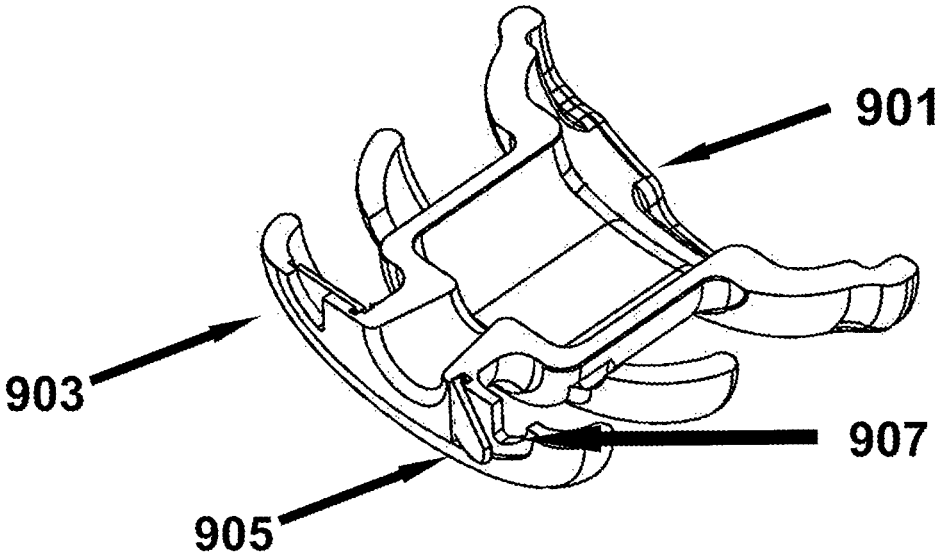
FIG. 09 illustrates a cutaway view of pressure relief flap 905 on comfort tip 901 automatically opening as the wireless in-ear utility device (e.g., the wireless in-ear utility device 102 shown in FIG. 01) is being removed from the user's ear canal, according to an embodiment of the invention.

FIG. 09 illustrates a cutaway view of pressure relief flap 905 on comfort tip 901 automatically opening as the wireless in-ear utility device (e.g., the wireless in-ear utility device 102 shown in FIG. 01) is being removed from the user's ear canal, according to an embodiment of the invention.

Automatically opening the pressure relief flap 905 when the wireless in-ear utility device is removed from the ear canal eliminates the suction effect and discomfort or trauma to the user's ear drum.

The pressure relief flap 905 detects the suction effect as the relative pressures on both sides of the pressure relief inlet 907 begin to change as the wireless utility device is being removed from the user's ear canal. Various health and safety codes may have different requirements for such situations. According to one embodiment of the invention, the pressure relief flap 905 opens when the pressure differential on the pressure relief inlet 907 differs by approximately 0.125 PSI.

Figure 10:
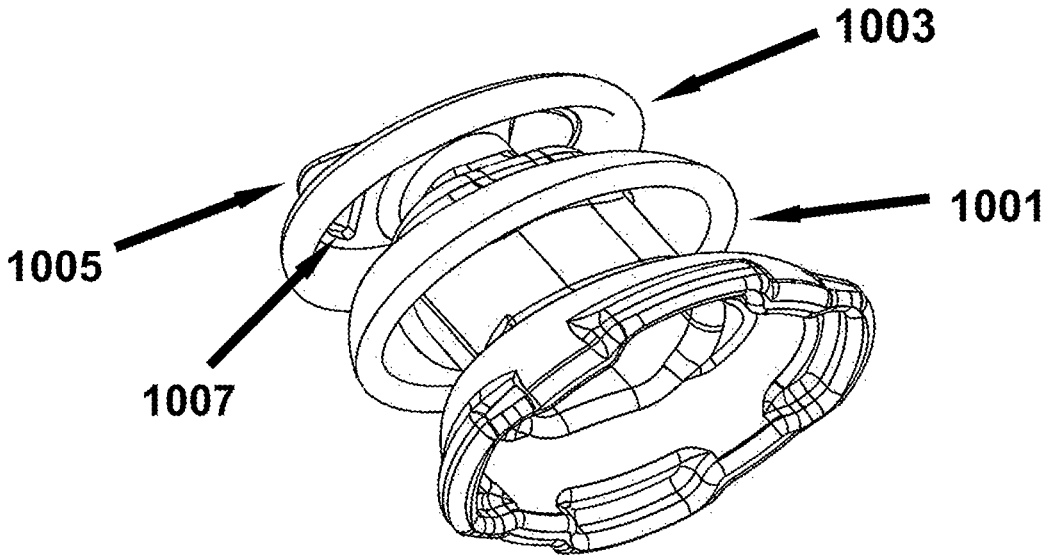
FIG. 10 illustrates pressure relief valves 1003, 1005 on comfort tip 1001 shown in a rear view with the pressure relief valve 1005 automatically open as the wireless in-ear utility device (e.g., the wireless in-ear utility device 102 shown in FIG. 01) is being removed from the user's ear canal, according to an embodiment of the invention.

FIG. 10 illustrates pressure relief valves 1003, 1005 on comfort tip 1001 shown in a rear view with the pressure relief valve 1005 automatically open as the wireless in-ear utility device (e.g., the wireless in-ear utility device 102 shown in FIG. 01) is being removed from the user's ear canal, according to an embodiment of the invention.

Automatically opening the pressure relief flap 1005 when the wireless in-ear utility device is removed from the ear canal eliminates the suction effect and discomfort or trauma to the user's ear drum.

The pressure relief flap 1005 detects the suction effect as the relative pressures on both sides of the pressure relief inlet 1007 begin to change as the wireless utility device is being removed from the user's ear canal. Various health and safety codes may have different requirements for such situations. According to an embodiment of the invention, the pressure relief flaps 1003, 1005 open when the pressure differential on the pressure relief flaps 1003, 1005 differ by approximately 0.125 PSI to 0.25 PSI.

Figure 11:
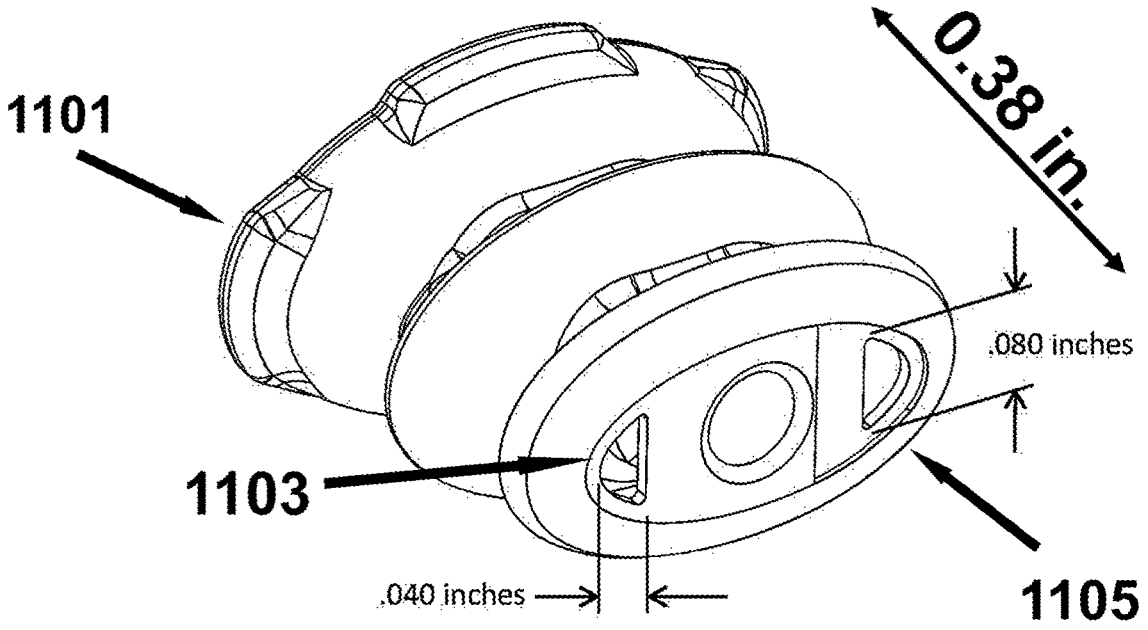
FIG. 11 illustrates dimensions for pressure relief openings 1103, 1105 of a comfort tip 1101, according to an embodiment of the invention.

FIG. 11 illustrates dimensions for pressure relief openings 1103, 1105 of a comfort tip 1101, according to an embodiment of the invention.

When the overall length of the comfort tip 1101 is approximately 0.38 inches, then an appropriate dimension for pressure relief opening 1103 would be approximately 0.04 inches from the middle of the baseline perpendicular to the top of the keystone position. The baseline portion of the pressure relief opening 1105 is approximately 0.08 inches, according to an embodiment of the invention. The pressure relief openings 1103, 1105 should typically have approximately the same dimensions, according to an embodiment of the invention.

Figure 12:
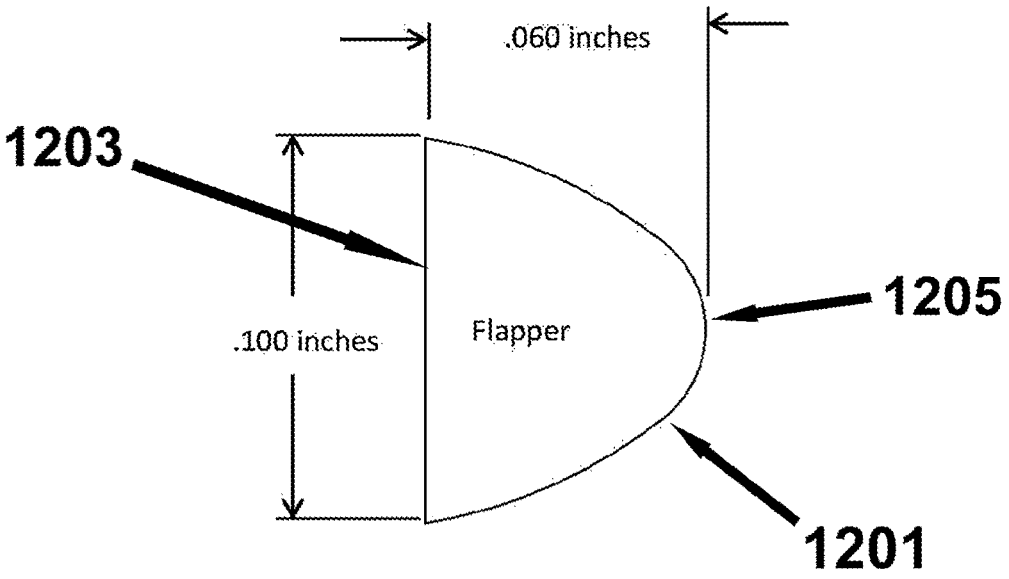
FIG. 12 illustrates dimensions for a pressure relief flap 1201 for a pressure relief opening (e.g., the pressure relief openings 1103, 1105 shown in FIG. 11), according to an embodiment of the invention.

FIG. 12 illustrates dimensions for a pressure relief flap 1201 for a pressure relief opening (e.g., the pressure relief openings 1103, 1105 shown in FIG. 11), according to an embodiment of the invention. If the pressure relief flap 1201 has been designed for a comfort tip having approximately the dimensions of the comfort tip 1101 shown in FIG. 11, then the height of the pressure relief flap from the baseline 1203 to the keystone position 1205 of the arch is approximately 0.06 inches, according to an embodiment of the invention. The baseline 1203 itself is approximately 0.1 inches in length, according to an embodiment of the invention.

Thus, the flap 1201 has slightly larger dimensions than the pressure relief openings 1103, 1105 shown in FIG. 11. These slightly larger dimensions allow the flap 1201 to cover the pressure relief opening 1103, 1105 completely in operation.

Figure 13:
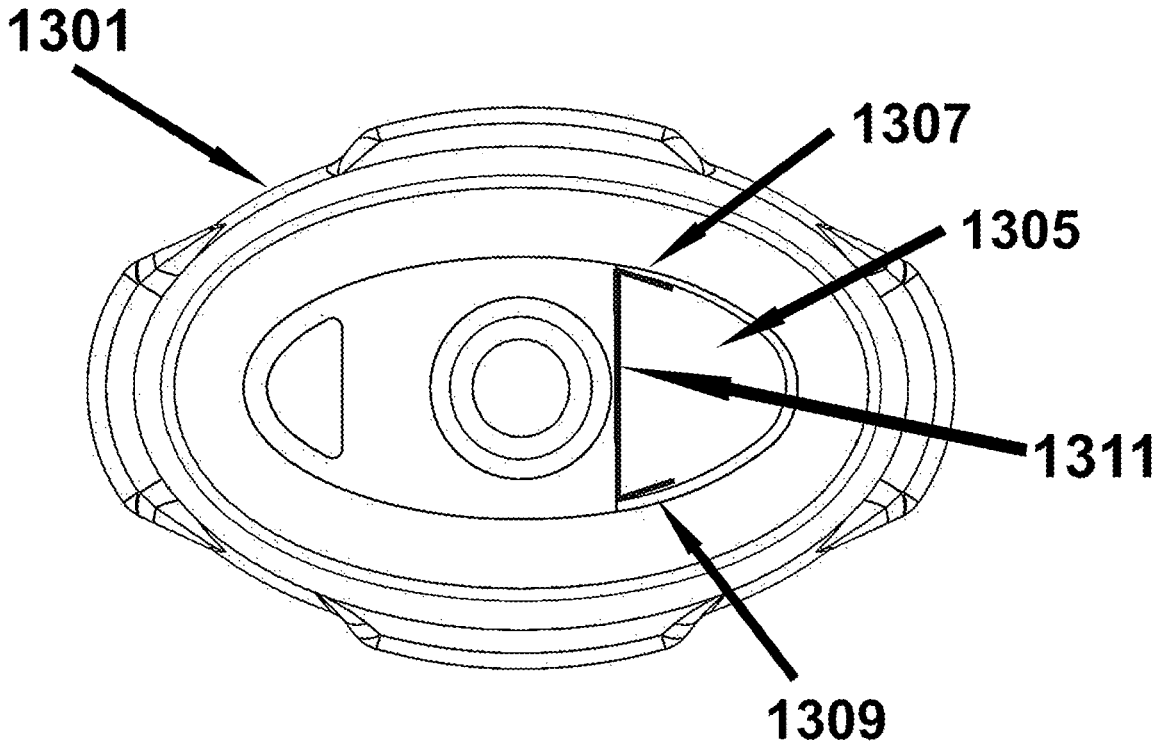
FIG. 13 illustrates a bond line comprised of three portions 1307, 1309, 1311 for attaching a pressure relief flap (e.g., the pressure relief flap 1201 shown in FIG. 12) to a comfort tip 1301 over a pressure relief opening 1305 viewed from the portion of the comfort tip 1301 that rests most closely to the user's tympanic membrane (approx. 7-15 mm. away) when the in-ear utility device is inserted into the user's ear, according to an embodiment of the invention.

FIG. 13 illustrates a bond line comprised of three portions 1307, 1309, 1311 for attaching a pressure relief flap (e.g., the pressure relief flap 1201 shown in FIG. 12) to a comfort tip 1301 over a pressure relief opening 1305 viewed from the portion of the comfort tip 1301 that rests most closely to the user's tympanic membrane (approx. 7-15 mm. away) when the in-ear utility device is inserted into the user's ear, according to an embodiment of the invention.

A pressure relief flap (e.g., the pressure relief flap 1201 shown in FIG. 12) may be attached at the bond line of the pressure relief opening 1305 on the comfort tip 1301 with silicone adhesive. Other materials and attachment methods may be employed, but experiments have shown that silicon adhesive tends to have the best mix of properties.

The length of bond lines 1307, 1309 determine how much pressure will be needed to open the pressure relief valve, according to an embodiment of the invention. For example, the shorter the bond lines 1307, 1309, then the less pressure need to open the pressure relief valve. A bond line 1311 acts as a hinge for the pressure relief value.

The bond lines 1307, 1309, 1311 should be examined to verify that they the epoxy has been applied evenly with no gaps. The completed comfort tip 1301 with attached pressure relief flaps should be tested to verify that the flaps open and close within the desired pressure range.

The comfort tip and pressure relief flap are both silicone rubber and could last indefinitely, but for good ear health the recommendation the comfort tip should be replaced approximately once a month, according to an embodiment of the invention.

A pressure relief flap (e.g., the pressure relief flap 1201 shown in FIG. 12) is typically only bound using epoxy at low production volumes and to calibrate the opening and closing of the flap, determined by the slit/boding area of the flap. For high production volumes, the cross sectional area of the flap may be an integral part of the seal as one piece and die-cut at the precise locations to function like the bonded flap shown in FIG. 13, according to an embodiment of the invention. In other words, the pressure relief flap 1201 shown in FIG. 12 may be integral with the comfort tip 1301 but simply die-cut at the appropriate locations, according to an embodiment of the invention.

Figure 14:
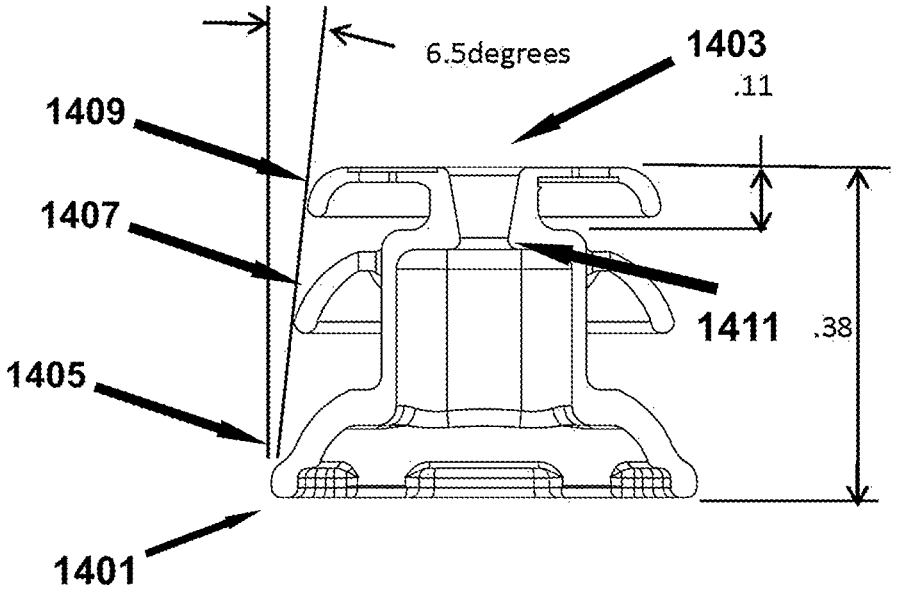
FIG. 14 illustrates a comfort tip 1401 having a speaker port 1403 that is designed to mimic an acoustic horn affect, according to an embodiment of the invention.

FIG. 14 illustrates a comfort tip 1401 having a speaker port 1403 that is designed to mimic an acoustic horn affect, according to an embodiment of the invention. Applying the horn effect to the speaker's output increases the perceived output of sound from the speaker by 5 dB to 10 dB, without having to increase the volume. Among other things, this application of the horn effect should reduce power consumption for the wireless in-ear utility device since the speaker on the wireless in-ear utility device will be able to provide greater sound to the user at lower power levels in comparison with a comfort tip that does not provide an acoustic horn effect.

An acoustic horn or waveguide is a tapered sound guide designed to provide an acoustic impedance match between a sound source and free air. This has the effect of maximizing the efficiency with which sound waves from the particular source are transferred to the air. In the case of the comfort tip 1401, the horn effect is used to maximize the efficiency with which sound waves from the speaker 1411 on a solid wireless in-ear utility device (e.g., the solid portion 100 of the wireless in-ear utility device 102 shown in FIG. 01) are transferred to the air of the ear canal and onto the user's tympanic membrane.

The decreasing size of the three rings 1405, 1407, 1409 also allows the comfort tip 1401 to more easily navigate into the user's ear canal. Thus, ring 1405 as a greater outer diameter than ring 1407, which itself has a greater outer diameter than ring 1409, the innermost ring, according to an embodiment of the invention. The degree of inclination of the rings 1405, 1407, and 1409 relates to the overall length of the comfort tip 1401, according to an embodiment of the invention.

Figure 15:
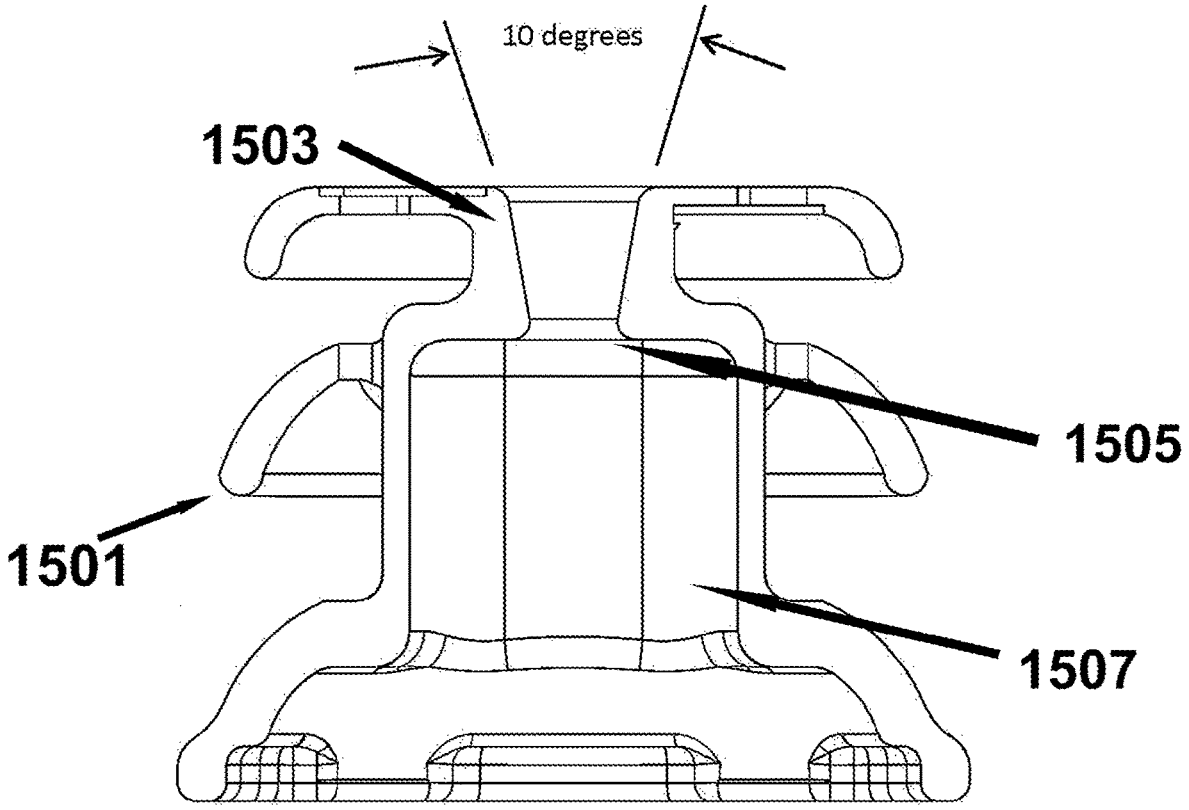
FIG. 15 illustrates the inclination of the wall of horn 1503 on a comfort tip 1501 that has been mounted on an in-ear device 1507, according to an embodiment of the invention.

FIG. 15 illustrates the inclination of the wall of horn 1503 on a comfort tip 1501 that has been mounted on an in-ear device 1507, according to an embodiment of the invention. The horn 1503 amplifies sounds output by the speaker 1505, which is an element of the in-ear utility device 1507 (e.g., the wireless in-ear utility device 102 shown in FIG. 01).

If the comfort tip 1501 has approximately the same dimensions as the comfort tip 1401 shown in FIG. 14, then the interior walls of the horn 1503 radiates outward at a 10 degree angle, according to an embodiment of the invention.

Various embodiments of the invention have been described in detail with reference to the accompanying drawings. References made to particular examples and implementations are for illustrative purposes, and are not intended to limit the scope of the invention or the claims.

It should be apparent to those skilled in the art that many more modifications of the in-ear utility device besides those already described are possible without departing from the inventive concepts herein. The inventive subject matter, therefore, is not to be restricted except by the scope of the appended claims. Moreover, in interpreting both the specification and the claims, all terms should be interpreted in the broadest possible manner consistent with the context.

Headings and sub-headings provided herein have been provided as an assistance to the reader and are not meant to limit the scope of the invention disclosed herein. Headings and sub-headings are not intended to be the sole or exclusive location for the discussion of a particular topic.

While specific embodiments of the invention have been illustrated and described, it will be clear that the invention is not limited to these embodiments only. Embodiments of the invention discussed herein may have generally implied the use of materials from certain named equipment manufacturers; however, the invention may be adapted for use with equipment from other sources and manufacturers. Equipment used in conjunction with the invention may be configured to operate according to conventional protocols (e.g., Wi-Fi) and/or may be configured to operate according to specialized protocols. Numerous modifications, changes, variations, substitutions and equivalents will be apparent to those skilled in the art without departing from the spirit and scope of the invention as described in the claims. In general, in the following claims, the terms used should not be construed to limit the invention to the specific embodiments disclosed in the specification, but should be construed to include all systems and methods that operate under the claims set forth hereinbelow. Thus, it is intended that the invention covers the modifications and variations of this invention provided they come within the scope of the appended claims and their equivalents.

It should be noted that while many embodiments of the invention described herein are drawn to a smart wireless in-ear utility device, various configurations are deemed suitable and may employ various computing devices including servers, interfaces, systems, databases, agents, engines, controllers, or other types of computing devices operating individually or collectively. One should appreciate that any referenced computing devices comprise a processor configured to execute software instructions stored on a tangible, non-transitory computer readable storage medium (e.g., hard drive, solid state drive, RAM, flash, ROM, etc.). The software instructions preferably configure the computing device to provide the roles, responsibilities, or other functionality as discussed below with respect to the disclosed smart in-ear utility device.

All publications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

As used herein, and unless the context dictates otherwise, the terms "ambient noise" and "ambient sound" have been used synonymously. Similarly, "sound" and "noise" have been used synonymous, except where the context shows a difference in meaning, e.g., "meaningful sound from mere noise." Likewise, "coupled to" is intended to include both direct coupling (in which two elements that are coupled to each other contact each other) and indirect coupling (in which at least one additional element is located between the two elements). Therefore, the terms "coupled to" and "coupled with" are used synonymously. The terms "coupled to" and "coupled with" are also used euphemistically to mean "communicatively coupled with" where two or more networked devices are able to send or receive data over a network.

We claim:

1. A comfort tip for protecting a user's ear canal from a solid device portion of a wireless in-ear utility device, comprising:

a body portion configured to removably fit onto the solid device portion of the wireless in-ear utility device;

a first pressure relief opening on the body portion that resides closest to the user's tympanic membrane when the wireless in-ear utility device is inserted in the user's ear, the first pressure relief opening configured to allow passage of air between the user's inner ear region and the ambient environment, wherein the inner ear region comprises a portion of the user's ear canal between the proximal end of the wireless in-ear utility device and the user's tympanic membrane;

a second pressure relief opening on the body portion that resides closest to the user's tympanic membrane when the wireless in-ear utility device is inserted in the user's ear, the second pressure relief opening configured to allow passage of air between the ambient environment and the user's inner ear region;

a first pressure relief flap covering the first pressure relief opening when in closed position, the first pressure relief flap configured to mechanically open to decrease pressure in the user's inner ear when a harmful positive air pressure occurs in the user's inner ear region arising from an acoustic blast in the inner ear region in a range from 25 dB to 35 dB; and a second pressure relief flap covering the second pressure relief opening when in closed position, the second pressure relief flap configured to mechanically open to increase pressure in the user's inner ear when a harmful negative pressure occurs in the user's inner ear region.

2. The comfort tip of claim 1 wherein the first pressure relief flap is configured to open when the harmful positive pressure in the user's inner ear region occurs in a range from 0.125 psi to 0.25 psi.

3. The comfort tip of claim .1 wherein the second pressure relief flap is configured to open when the harmful negative pressure in the user's inner ear region occurs in a range from 0.125 psi to 0.25 psi.

4. The comfort tip of claim 1 wherein the body of the comfort tip is comprised of a resilient polymeric material having a Shore A Durometer hardness value (by a technique such as ASTM 2240-81) of between 20-30.

5. The comfort tip of claim 1 wherein the body of the comfort tip is comprised of a resilient polymeric material comprising at least one of natural rubber, neoprene rubber, SBR rubber, silicone rubber, EPDM rubber, polybutadiene rubber, polyvinylchloride elastomers, polyurethane elastomers, ethylene vinyls, acetate elastomers, elastomers based on acrylic acid precursors and vinyhalide polymers.

6. The comfort tip of claim 1 wherein the first pressure relief valve and the second pressure relief valve have been die-cut from the body of the comfort tip.

7. The comfort tip of claim 1, further comprising:

a plastic clip insert that attaches to the body of the comfort tip and allows the comfort tip to removably snap on to the solid device portion of the wireless in-ear utility device.

8. The comfort tip of claim 1, further comprising:

an outwardly angled horn on a surface of the body portion that resides closest to the user's tympanic membrane when the wireless in-ear utility device is inserted in the user's ear, the outwardly angled horn configured to substantially abut a speaker on the solid device portion of the wireless in-ear utility device, wherein the outwardly angled horn facilitates a horn effect that naturally amplifies sounds generated by the speaker.

9. The comfort tip of claim 1 wherein the outward angled horn is designed to increase user-perceived output of sound from the speaker by 5 dB to 10 dB.

10. The comfort tip of claim 1 wherein the body portion is configured to create a plurality of gaps between the body portion and the user's ear canal, wherein the plurality of gaps allow ambient sounds to pass through to the user's inner ear region.

11. The comfort tip of claim 1 wherein the body portion is configured to protect the user from electronic malfunctions arising from the solid device portion of the wireless in-ear utility device.

12. The comfort tip of claim 1 wherein the body portion is configured to fit to the solid device portion of the wireless in-ear utility device such that a speaker on the solid device portion of the wireless in-ear utility device resides 8 to 12 mm. away from user's. tympanic membrane when in an operable position in the user's ear canal.

* * * * *